United States Patent [19]

Rutledge

[11] 4,018,450

[45] Apr. 19, 1977

[54] BICYCLE-MOUNTED NOISE MAKER

[76] Inventor: James T. Rutledge, 7779 Royal Lane, Dallas, Tex. 75230

[22] Filed: June 30, 1975

[21] Appl. No.: 591,652

[52] U.S. Cl. ..... 280/289 R; 46/175 R; 280/1.1 R; 116/56

[51] Int. Cl.[2] ..... A63H 5/00

[58] Field of Search ..... 116/56; 46/175 R, 191, 46/189, 177; 301/37 SA, 105 B; 40/129 R; 280/289 R, 1.1 R, 1.14; 224/36 R

[56] References Cited

UNITED STATES PATENTS

| | | | |
|---|---|---|---|
| 2,624,156 | 1/1953 | Meyer, Jr. | 46/175 R X |
| 2,719,385 | 10/1955 | Wilson | 46/175 R |
| 2,721,421 | 10/1955 | Steele | 46/175 R |
| 2,894,357 | 7/1959 | Munro | 116/56 X |
| 3,121,293 | 2/1964 | Sperry et al. | 46/175 R |
| 3,684,347 | 8/1972 | Challe et al. | 280/289 X |
| 3,782,030 | 1/1974 | Gergovich | 46/175 R |
| 3,827,178 | 8/1974 | Warnoke | 116/56 X |

*Primary Examiner*—Richard C. Queisser
*Assistant Examiner*—Daniel M. Yasich
*Attorney, Agent, or Firm*—Berman, Aisenberg & Platt

[57] ABSTRACT

A bicycle noise making attachment consisting of an elongated member shaped to loosely receive a bicycle fender brace and having a slotted end lug adapted to be clampingly held by the same clamping nut employed to secure the wheel fender brace to the associated wheel axle bolt. The member itself is somewhat vibratory and has a vibratory integral noise-generating flap which extends between the wheel spokes and is vibrated by the spokes as the wheel rotates.

5 Claims, 9 Drawing Figures

FIG. 1.
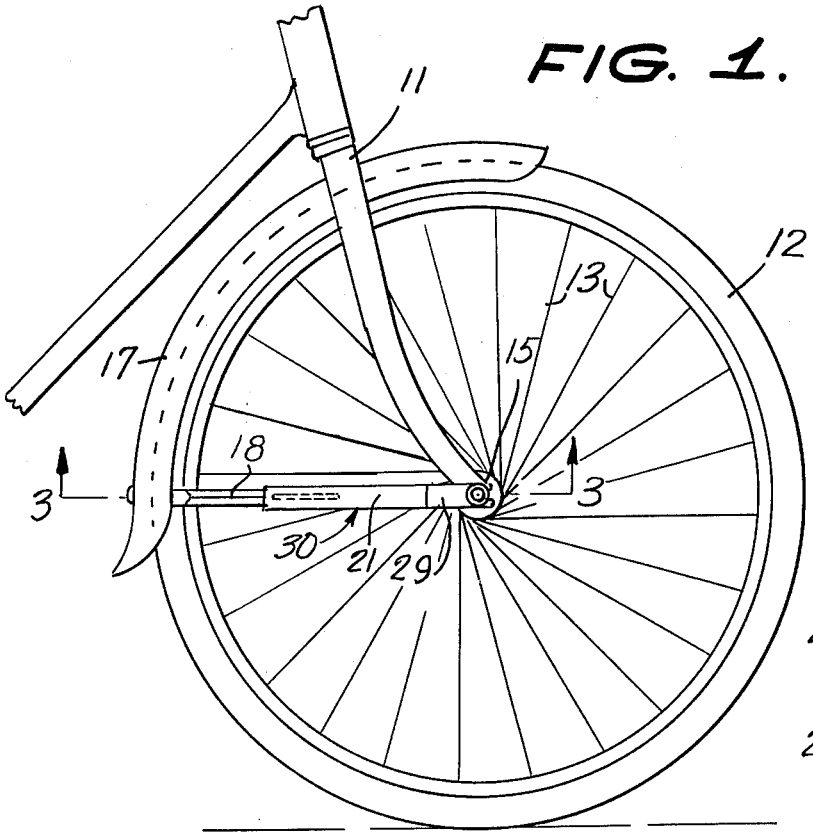
FIG. 2.
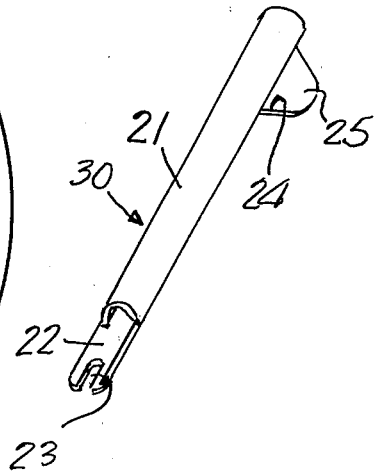
FIG. 3.
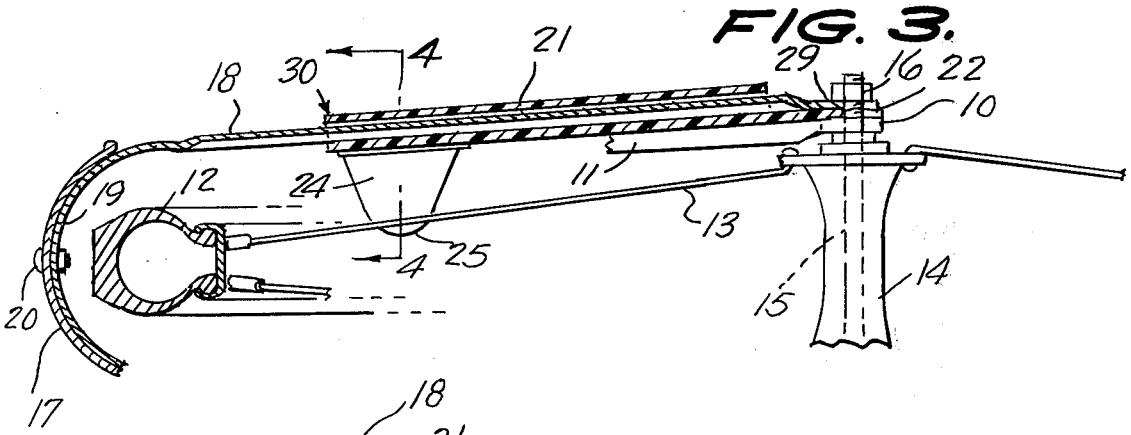
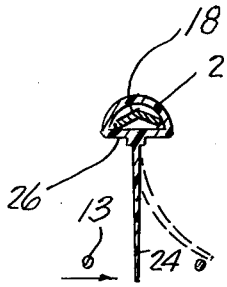
FIG. 4.

BICYCLE-MOUNTED NOISE MAKER

This invention relates to noise-making devices, and more particularly to a device which is mounted upon a bicycle adjacent a wheel thereof for the purpose of interacting with the spokes of the wheel in order to produce a noise.

A main object of the invention is to provide a novel and improved noise-making attachment for a conventional bicycle adapted to produce a noise simulating that of a motorcycle, the attachment being simple in construction, being easy to install on a bicycle, and being safe to use.

A further object of the invention is to provide an improved noise-making attachment for a bicycle, said attachment being inexpensive to manufacture, being rugged in construction, and being readily installed on a conventional bicycle without requiring any unusual tools and without requiring much labor.

A still further object of the invention is to provide an improved noise-making attachment adapted to be mounted on the fender brace associated with one of the wheels of a conventional bicycle and arranged to be held thereby in a position to cooperate with the spokes of the adjacent wheels so as to produce a vibratory noise simulating the noise produced by a motorcycle, the attachment being neat in appearance, being compact in size, and substantially not affecting the normal operation of the bicycle.

A still further object of the invention is to provide an improved noise-making attachment adapted to be mounted on a fender brace of a conventional bicycle, the attachment being arranged to intereact with spokes of the adjacent wheel to produce a vibratory noise, and the attachment providing an unusual audible effect because of the vibratory nature of its various parts, which combine to simulate the actual noise made by a motorcycle.

Further objects and advantages of the invention will become apparent from the following description and claims, and from the accompanying drawings, wherein:

FIG. 1 is a side elevational view of the front portion of a bicycle on which is mounted an improved noise-making attachment constructed in accordance with the present invention.

FIG. 2 is a perspective view of the noise-making attachment employed in FIG. 1.

FIG. 3 is an enlarged horizontal cross-sectional view taken substantially on line 3—3 of FIG. 1.

FIG. 4 is an enlarged transverse vertical cross-sectional view taken substantially on line 4—4 of FIG. 3.

Figure 5:
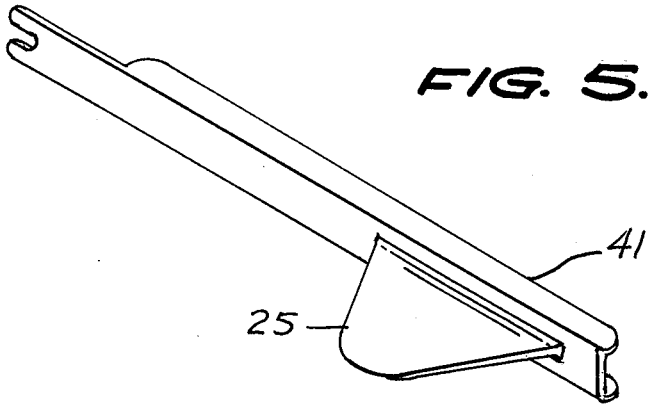
FIG. 5 is a perspective view of another form of the invention.
Figure 6:
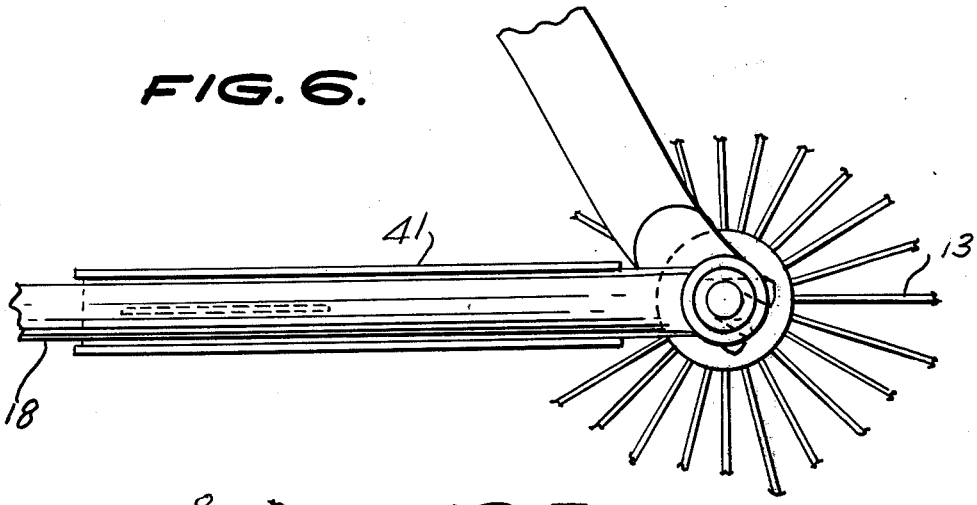
FIG. 6 is a side elevational view of the form shown in FIG. 5 when mounted on a brace bar of a bicycle.
Figure 7:
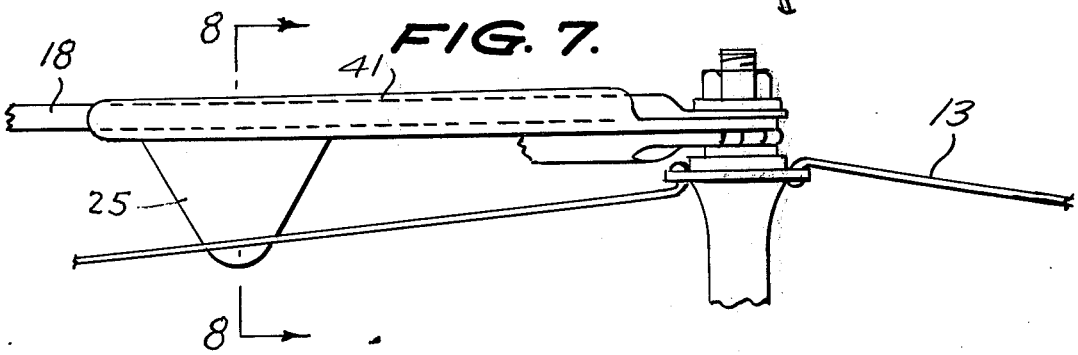
FIG. 7 is a top view of the form shown in FIG. 5 when mounted on a brace bar of a bicycle.

A prime purpose of the present invention is to provide a noise-making attachment adapted to be mounted on a conventional bicycle of the type equipped with a fender and a fender brace connecting the fender to the associated wheel axle bolt and acting to generate a periodic sound which closely simulates the sound made by a motorcycle, whereby a child riding the bicycle will derive the feeling of riding on an actual motorcycle, insofar as the audible sound is concerned. Amusement devices of this type heretofore employed have been merely concerned with producing a vibratory noise, and not attempting to closely simulate the sound of a motorcycle exhaust. The present invention is concerned not merely with providing a device which can be easily and conveniently mounted on a bicycle for such coaction with a wheel thereof, but also with producing a sound which is acoustically nearer to that of a motorcycle than the sounds which have been derived from previously employed devices of this nature.

Referring to the drawings, FIG. 1 illustrates a typical bicycle having a front wheel frame fork 11 and a wheel 12 journalled thereto. The wheel has a plurality of spokes 13 and a hub portion 14. The wheel 12 is journalled to the frame fork 11 by a wheel axle bolt 15 which extends rotatably through the hub portion 14 and through eyes 10 provided on the ends of the arms of the fork 11, and the wheel is secured in place by clamping nut 16 which is threadably engaged on the end of the axle bolt 15 and holds the eyes 10 clamped to suitable shoulder means on the axle bolt, whereby the wheel 12 freely rotates on the portion of the axle bolt extending through hub 14. The wheel 12 is provided with a fender 17 which covers the upper left portion of the wheel, as viewed in FIG. 1, and whose upper portion may be secured in a conventional manner to the upper portion of the fork 11 and whose lower portion is supported by means of a conventional fender brace bar 18 having an end portion engaged with the end of the axle bolt 15 and clamped by the nut 16.

As shown in FIG. 3, the conventional brace bar 18 is provided with an arcuate outer end portion 19 which is conformably received against the inside surface of the fender 17 and which is secured thereto by a fastening bolt 20. In the typical conventional bicycle illustrated, the fender brace bar 18 is a generally V-shaped cross-section, as shown in FIG. 4, with the crest portion of the V-shaped brace bar directed outwardly.

Figure 9:
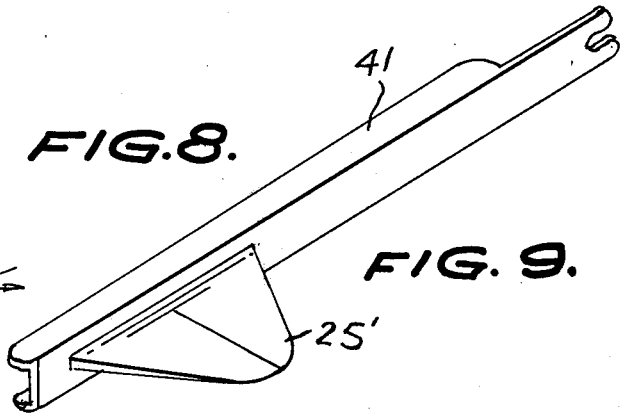
FIG. 9 is a perspective view of a modified form of the invention.

Designated generally at 30 is a partially enclosed noise making attachment according to the present invention, said attachment comprising a main tubular sleeve portion 21 formed at one end with a flat lug 22 having a longitudinal open ended slot 23 therein, and formed at the other end with a spoke-engaging flap 24 which projects perpendicular to the plane of the lug 22, as shown in FIG. 3. The flap 24 may be of any suitable shape, for example, being generally triangular in shape with an arcuately rounded apex portion 25. If desired, the flap 24' may be split into two segments as shown in FIG. 9. The sleeve portion 21 may be of generally semicircular shape in cross-section, as shown in FIG. 4, and the lug 22 may be an extension of the flat diametrical wall portion 26 of tubular sleeve member 21.

The tubular sleeve member 21 is of substantial length, for example, approximately two-thirds the length of the fender bar 18 on which it is to be mounted, and is of sufficient size to loosely receive the fender bar and to be non-rotatably engaged therewith, whereas the flap 24 is relatively thin and flexible so that it can be flexed by the spokes 13 as the wheel 12 rotates. The attachment 21 may be formed of relatively durable plastic material, with a wall thickness allowing the tubular member 21 to vibrate along its length along with the vibration of the flap member 24, as will be presently described.

As will be seen from FIG. 3, the flap member 24 is of sufficient length so that it will project between adjacent spokes 13 of a bicycle wheel 12 when the device is mounted on the V-shaped portion of the fender bar 18.

The noise-making device 30 is installed by first removing axle nut 16, flexing the fender bar 18 away from the axle bolt 16 sufficiently to disengage its slotted end portion 29 from the axle bolt, whereby to provide sufficient clearance to slide the tubular member 21 onto the fender bar. The tubular member 21 is then slid onto the fender bar sufficiently to allow the slotted lug 22 to be moved so that its slot 23 receives the end of the axle bolt 15, after which the slotted end portion 29 of the fender bar is re-engaged on the axle bolt and the clamping nut 16 is replaced and tightened. This places the flap member 24 in the position shown in FIG. 3, wherein it projects between adjacent wheel spokes 13.

In operation, as the wheel 12 rotates, the flap member 24 is repeatedly flexed in the manner shown in FIG. 4 in dotted view and is then released as the spokes 13 move therepast, causing the flap 24 to vibrate. The flexure of the flap member 24 is transmitted to the tubular member 21, which develops a substantial amount of vibration therefrom, and the combined vibrations of the flap member 24 and the tubular member 21 cooperate to produce a sound closely simulating the sound of a motorcycle. The amount of supplemental vibrations produced by the sleeve member 21 depends upon the degree of looseness with which it receives the fender brace bar 18. Normally, there will be sufficient looseness to allow a substantial amount of vibration of the tubular member 21 which will thus contribute to that produced by the vibrating flap member 24 and provide a sound closely simulating the sound of an actual motorcycle.

Figure 8:
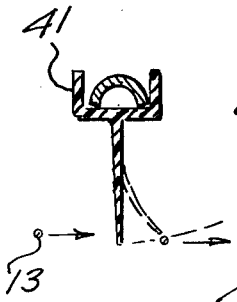
FIG. 8 is a cross-sectional view taken along line 8—8 of FIG. 7

The modified form of the invention shown in FIGS. 5–8 is substantially the same in construction, mounting and operation as the form shown in FIGS. 1–4. However, as best seen in FIGS. 5 and 8, the elongated member 41 is U-shaped or channel-shaped, instead of tubular, so as to facilitate mounting of the noise making device on the brace bar 18. It has been found that this modified form emits a louder and lower pitched sound than the form shown in FIGS. 1–4.

The noise making device may be fabricated from any suitable material, including relatively rigid plastic. If desired, the device may be formed from a light-reflective material, such as fluorescent polypropelene, in order to add a safety feature to the device.

The noise making device may be mounted on either the front wheel of the bicycle, as illustrated in the drawings, or alternatively on the rear wheel of the bicycle, as long as a fender brace bar is present adjacent the rear wheel. Most conventional bicycles are provided both with front fenders and rear fenders and usually have fender brace bars similar to the brace bar 18 illustrated in the drawings. Therefore, the noise making attachment can be employed with a very wide range of current models of bicycles.

While a specific embodiment of an improved bicycle noise-making attachment has been disclosed in the foregoing description, it will be understood that various modifications within the spirit of the invention will occur to those skilled in the art. Therefore, it is intended that no limitations be placed on the invention except as defined by the scope of the appended claims.

What is claimed is:

1. A noise making attachment adapted to be mounted on a vehicle with at least one wheel having spokes, an elongated brace bar adjacent said wheel and mounted with a wheel axle bolt, comprising:

a. a unitary member comprising a vibratory flap and an elongated, at least partially enclosed, vibratory means for vibrating in response to the vibrations of said flap so that the combined vibrations of said flap and elongated means simulate the sound of a motorcycle, said brace bar extending longitudinally through said elongated vibratory means so as to prevent said attachment from rotating when said wheel rotates; and b. a member attached to said unitary member provided with an opening therein adapted to receive the wheel axle bolt of said vehicle for mounting said noise making attachment to said vehicle in a manner such that said flap extends between said spokes, causing said flap to vibrate when said wheel rotates.

2. The noise making attachment of claim 1, and wherein said elongated member is tubular.

3. The noise making attachment of claim 2, and wherein said tubular member is substantially semi-circular in cross-section.

4. The noise making attachment of claim 1, and wherein said elongated member is U-shaped in cross-section.

5. The noise making attachment of claim 1 wherein said flap means is segmented.

* * * * *